United States Patent [19]

Hollenbach

[11] 4,412,646

[45] Nov. 1, 1983

[54] TWO-PIECE MECHANICAL FLAG

[76] Inventor: David A. Hollenbach, 777 Irvin-Shoots Rd., Marion, Ohio 43302

[21] Appl. No.: 372,577

[22] Filed: Apr. 28, 1982

[51] Int. Cl.[3] ..... A47G 29/12

[52] U.S. Cl. ..... 232/34; 232/35; 116/319

[58] Field of Search ..... 232/34–37; 273/127 D, 387, 389, 400, 401; 40/594, 601; 116/307, 306, 309, 319, 313, 175; 46/1 K, 221

[56] References Cited

U.S. PATENT DOCUMENTS

| | | | |
|---|---|---|---|
| 196,982 | 11/1977 | Lyman | 273/127 D |
| 910,555 | 1/1909 | Lumbard | 116/319 |
| 968,151 | 8/1910 | Harmon | 232/34 |
| 1,207,101 | 12/1916 | Wade | 232/34 |
| 2,843,316 | 7/1958 | Auger | 232/34 |
| 3,338,511 | 8/1967 | Cvar | 232/35 |
| 3,386,649 | 6/1968 | Joyce | 232/34 |
| 3,602,424 | 8/1971 | Raulston | 232/35 |
| 3,624,961 | 12/1971 | Brubaker | 46/221 |
| 3,866,823 | 2/1975 | Grayson | 232/35 |
| 3,889,874 | 6/1975 | Arwood | 232/35 |
| 3,915,112 | 10/1975 | Forester | 116/319 |
| 3,958,752 | 5/1976 | Pieszchala | 232/35 |
| 4,147,292 | 4/1979 | Fisher | 232/35 |
| 4,182,479 | 1/1980 | Swift | 232/35 |
| 4,915,534 | 2/1893 | Cushing et al. | 232/21 |

FOREIGN PATENT DOCUMENTS

| | | | |
|---|---|---|---|
| 110140 | 11/1966 | Norway | 273/387 |

*Primary Examiner*—John J. Wilson

*Attorney, Agent, or Firm*—Millard & Cox

[57] ABSTRACT

A signaling device for mounting on the front of a newspaper tube will pivot from a position perpendicular to the axis of the tube to one parallel with the axis of the tube upon the insertion of the newspaper or mail by virtue of the inserted material engaging one end of a pivoting arm which serves as the signaling device.

8 Claims, 9 Drawing Figures

TWO-PIECE MECHANICAL FLAG

Field of the Invention

This invention relates to a flag or other signaling device for indicating to a remote observer that something has been inserted into a mailbox or into a newspaper tube which may be mounted adjacent the roadway some distance from the residence.

BACKGROUND OF THE INVENTION

Mailboxes and tubes for the reception of newspapers are traditionally mounted on a post adjacent the roadway in rural areas of the United States. Indeed, in many suburban locations the same is true because of the postal regulations limiting delivery to the door. These mailboxes are often a substantial distance from the house. This is not a problem on a dry summer morning when one goes to the newspaper tube to pick up his morning paper. However, it is a minor problem when it is snowing, the temperature is 5° F. and the wind is blowing 20 mph. However, that is not the real problem. The real problem is having to make that trip more than once in the morning. The homeowner knew of the problem when he built the house and he knew he would have to make a trip out to that newspaper tube which he put up to keep the newspaper dry, but there is no present convenient way for that poor homeowner to know when the newspaper man is late in arriving.

Therefore, it is desirable to have some simple, convenient, easy to install signaling mechanism which will indicate to the homeowner that the paper has or has not been inserted into the convenient newspaper tube prior to the time the homeowner leaves his front door.

There are several spring actuated devices disclosed in the prior art and most are associated with mailboxes. Also, most are actuated by some mechanical connection between the door of the mailbox and the actuating mechanism. Additionally, most are bolted or riveted to the mailbox itself.

The bolting or riveting of a separate metallic device to the painted or galvanized mailbox does two undesirable things. The first is that it exposes the hole surface to the atmosphere because the steel that defines the surface of the hole is then exposed to the elements even though one may attempt to seal the hole. Obviously, the tighter a bolt is clamped, the better the seal is to the hole, but the harder it is to rotate the arm which is held to the mailbox by said bolt. The other problem is axiomatic, that is, no matter how good the seal, the hole will eventually leak and the water will get into the box and thereby moisten the inserted printed matter.

Another problem with the prior art devices is the plurality of moving parts to accomplish the desired result. Pivoting metal parts inherently wear and corrode and within a short period in the rural northern climates, particularly where salt is used on the highways and inherently splashed upward onto the mailbox from time to time, the metal parts will corrode and become inoperative. Replacement every year or so is not a practical solution.

There is a need for a simple device which will signal to the homeowner while he is still inside his home that someone has delivered the newspaper or the mail, but which signaling device will be simple of operation, have a minimum of moving parts, and not be prone to the corrosion inherent in the previously disclosed apparatus which attempted to solve the same problem.

BRIEF DESCRIPTION OF THE INVENTION

The invention herein involves a signal formed of two pieces of plastic material (polypropylene or the like) joined to a rod about which at least one of the pieces may pivot.

The first piece is a plastic mounting member having a flat mounting surface at one end. The mounting surface itself will be of sufficient width and length to support the weight of the remainder of the apparatus and that may vary depending upon the density and thickness of the other parts. In any case, the flat surface has a pressure sensitive adhesive covering which is in turn covered by a peel sheet of conventional nature and well known in the art. The surface bearing the pressure sensitive adhesive is applied to the mailbox or newspaper tube which will mount the device in operative position.

On the opposite end of the mounting member from the pressure adhesive is a bar about which the second of the plastic elements may pivot. The mounting member may or may not be pivotable with respect to the cylindrical bar but whether it is or is not is totally immaterial to effective operation of the signaling device.

The second plastic element snaps onto the cylindrical bar from which it pivots. The pivot point of the second element is at about its mid-point and the element or pivoting arm is of a length which will extend about half way across the mouth of most conventional mailboxes or newspaper tubes and will extend roughly the equivalent distance in the other direction beyond the cylindrical bar. Thus, when the homeowner removes the newspaper or other printed matter from the tube, he will set the pivoting arm so that it extends across the mouth of the tube in a plane approximately perpendicular to the axis of the tube. The other portion of the second plastic element will extend transversely of the periphery of the tube and be visible in almost all directions and so long as it is visible, it will be clear to the observer that nothing has been inserted into the tube since the signaling device was last set in operative position.

However, should something be inserted into the tube after the elements have been set in operative position, the newspaper or other printed matter inserted will push the pivoting second member out of the way (or if it is on a mailbox the opening of the door will push the second member out of the way) and thereby the signaling portion of the pivoting element will no longer be visible since it will pivot out of sight. The clear indication to the remote observer is that something has been inserted or removed from the box. In either case, the appropriate signal will be given to the homeowner-observer and the homeowner will not have to make a fruitless trip to the road to find an empty newspaper tube or mailbox.

BRIEF DESCRIPTION OF THE DRAWINGS

FIG. 5 is a bottom-plan view of the signaling device of

FIG. 1.

DESCRIPTION OF THE PREFERRED EMBODIMENTS

Figure 1:
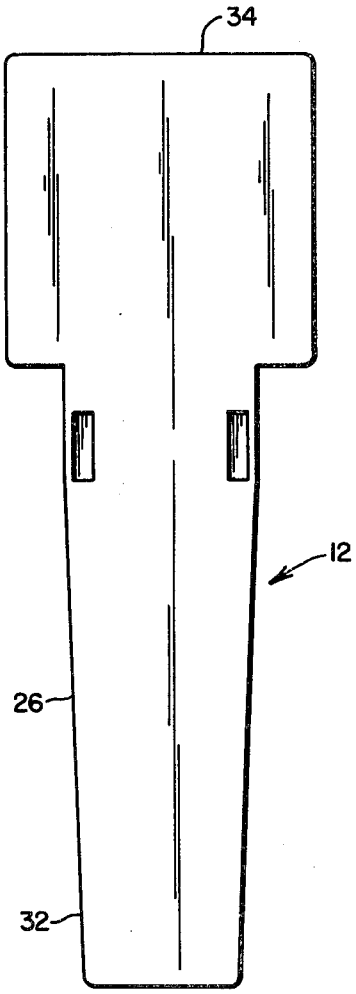
FIG. 1 is a front elevational view of the signaling device of this invention.
Figure 2:
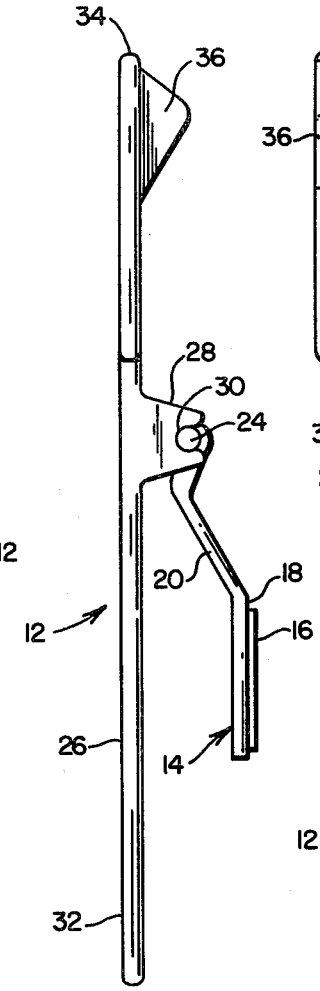
FIG. 2 is a side elevational view of FIG. 1.
Figure 3:
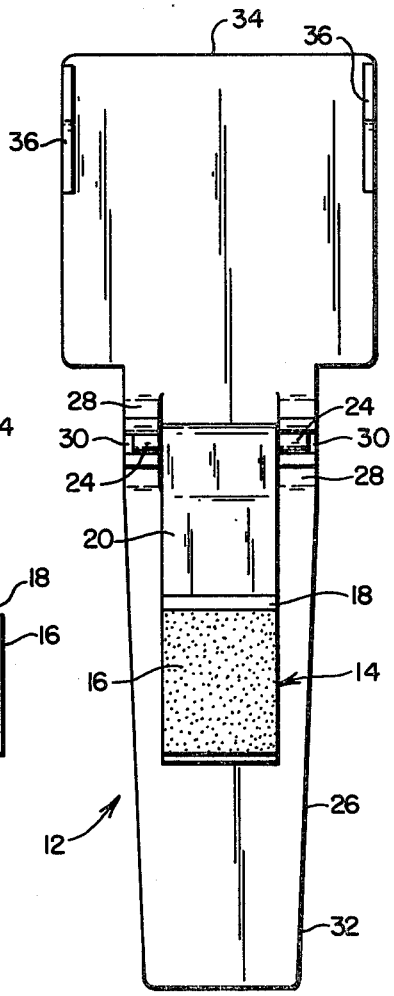
FIG. 3 is a rear elevational view of the signaling device of FIG. 1.
Figure 4:
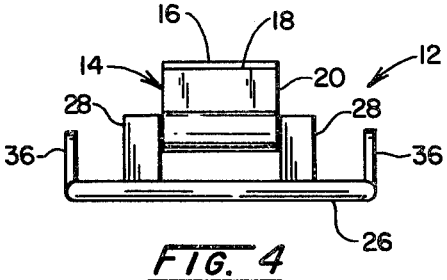
FIG. 4 is a top-plan view of the signaling device of FIG. 1.
Figure 5:
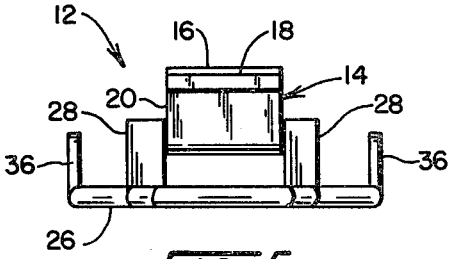
Figure 6:
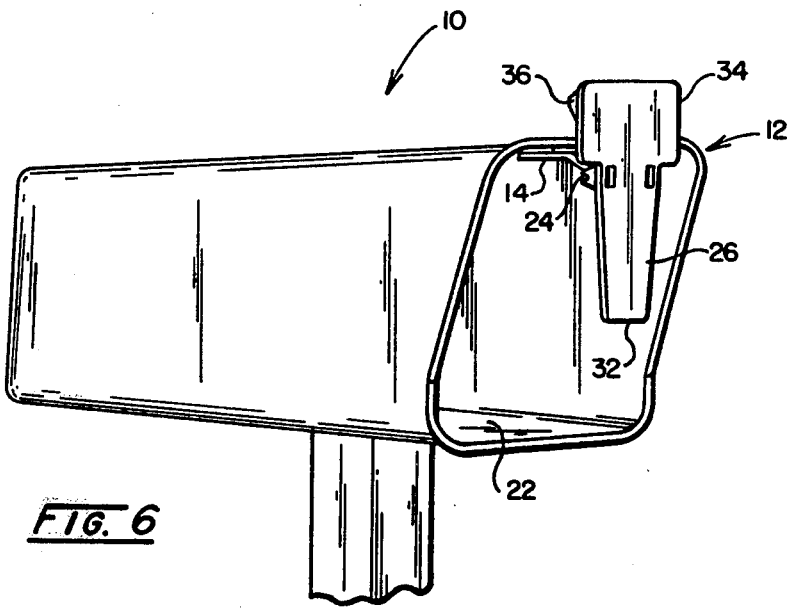
FIG. 6 is a perspective view of the signaling device of this invention mounted on a newspaper tube and shown in operative position.
Figure 7:
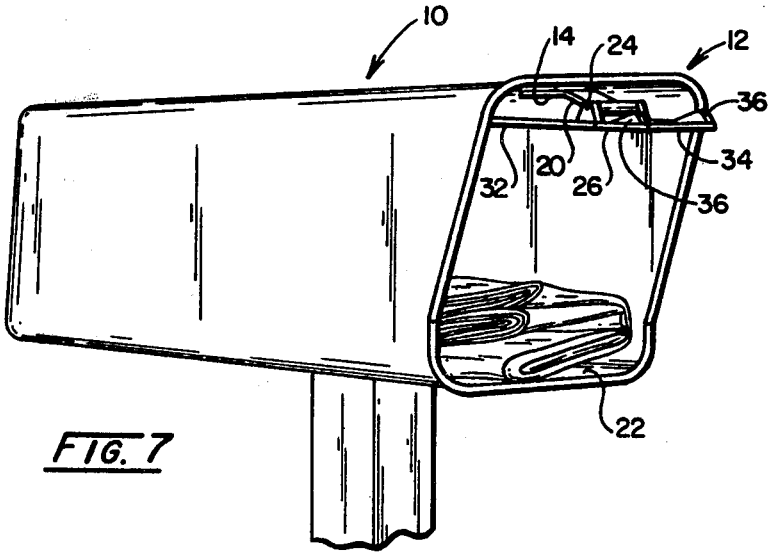
FIG. 7 is a perspective view of FIG. 6 shown with the newspaper inserted and the signaling device rotated to a position indicating the newspaper has been inserted.

Referring to FIGS. 6 and 7, a newspaper tube 10 is shown with the two-piece plastic signaling device 12 mounted thereon. As is conventional with all newspaper tubes, mailboxes, and the like for the obvious intended purpose, the tube which houses the printed matter to be protected from the elements is linear in extent and is usually inclined ever so slightly downward toward the mouth of the tube to prevent water from collecting in the tube. Many of such tubes have a small hole at the bottom rear of the tube for draining purposes, in case water does blow in.

In the embodiment shown, a first piece or mounting member 14 is affixed to the interior surface of the tube 10. It is held in place by a pressure sensitive adhesive 16 which coats a flat portion 18 of the mounting element. As the device is packaged and shipped to the homeowner, the pressure sensitive adhesive 16 will be covered with a peel sheet (not shown) of conventional design which will be stripped from the adhesive immediately prior to its application to the surface of the tube. As with all such applications, the instructions will indicate that the user should wash the surface clean of dirt and oil and dry it completely before the pressure sensitive adhesive is applied thereto.

The mounting element 14 includes an offset portion 20 which extends both longitudinally and radially inward toward the axis of the tube 10. The offset 20 allows for easier mounting of the mounting member and in addition, extends the mounting element beyond the mouth 22 of the tube 10 such that the pivot point embodied in the cylindrical pin 24 extends beyond the mouth 22.

A pivot arm 26 is removably mounted to pivot about the axis of the pin 24 as will be explained subsequently.

The means for connecting the pivot arm to the cylindrical pin 24 is by way of a pair of flanges 28 having paired slots 30 therein. The mouths of slots 30 neck down to a diameter less than the diameter of pin 24 but flare outward in each direction with the outermost flare serving as a guide for centering the pin in place as the pivot arm is being assembled on the pin. The inward flare from the mouth is into a cylindrical surface which is roughly the diameter of the pin 24. In assembling the device, the slotted flanges will snap into place over the pin and the frictional contact between the pin and the slot will prevent the pivot arm 26 from rotating with respect to pin 24 except by the exertion of a certain amount of force such as would be inherent if a newspaper was shoved into the mailbox and one end or the other of the pivot arm was in the way. Specifically, the frictional engagement between the slot 30 and the pin 24 is sufficiently great that the pivot arm would not pivot due to gravity or the wind unless it was a particularly powerful wind.

As shown in the operative position, the lower end 32 of the pivoting arm extends downwardly approximately ½ the diameter of the mouth 22 while the upper end 34 serves as the signal device and extends upwardly above the peripheral surface of the tube 10. Thereby, persons standing a substantial distance away from the newspaper tube 10 will be able to observe the upstanding flag or signal portion 34 without having to go to the tube to discover whether or not something has been inserted therein. It will be clear to anyone that the narrower portion 32 of the pivoting arm could be the upper end and still function equally as well. The narrow end and the wide end of the pivot arm are identified merely for purposes of discussion herein. It is clear that they could be of the same width or the width could be purely arbitrary. The dimensions have nothing to do with the functioning of the invention.

Figure 8:
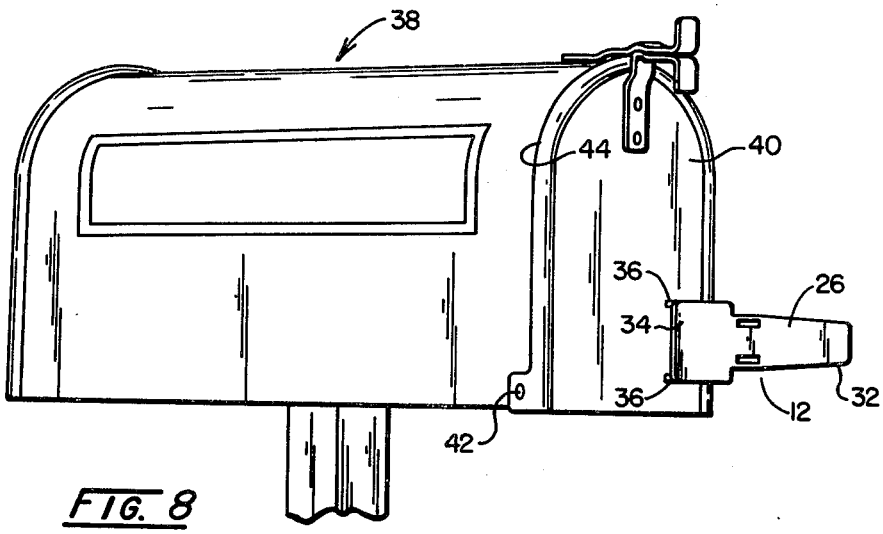
FIG. 8 shows a mailbox having the signaling device mounted on one side thereof and shown in signaling position.
Figure 9:
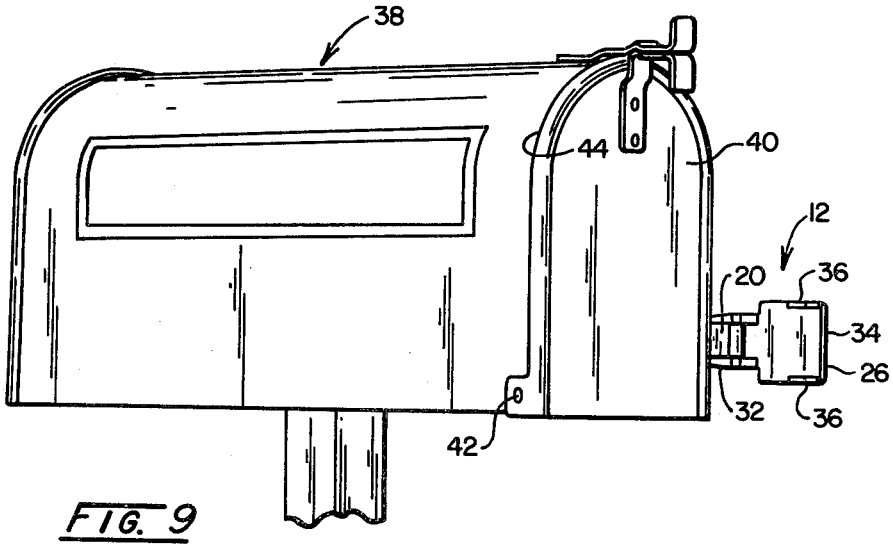
FIG. 9 shows the orientation of the signaling device after the door of the mailbox of FIG. 8 has been opened and again closed.

One or more V-shaped projections 36 are shown formed integral with the wide end of the pivot arm. They have no function in relation to a newspaper tube. However, they do have a function in relation to a mailbox 38 having a door 40 hinged at 42 from one edge of the mouth 44 as seen in FIGS. 8 and 9.

The projections 36 serve as a cam surface for engaging the door 40 when it is opened by the mailman or others and will serve to signal the household observer that the door 40 has been opened since the pivot arm 26 was originally set in operative position.

In operation, the two-piece signaling device 12 will first be affixed to the internal (or optionally the external) surface of the newspaper tube and the pivot arm 26 will be set so that the narrow end 32 of the pivot arm extends partially across the mouth 22 of the tube to partially obstruct the opening. Thereby, when someone shoves a newspaper into the tube 10 it will inherently pivot the narrow end 32 of the pivot arm into the tube 10 which will cause the wide end 34 to pivot down such that the arm 26 will be roughly parallel to the axis of the tube 10 when the newspaper has been inserted.

It will be clear on observance of the two-piece element that prior to the time the adhesive 16 is engaged with the surface of the tube 10, the pivot arm may pivot roughly 180° about the cylindrical pin 24 with the exception of the angle subtended by the width of the mounting element 14. However, once the pressure sensitive adhesive 16 is pressed into place, the pivot arm will be limited in its pivoting to roughly 90° from a point where the pivot arm is roughly perpendicular to the axis of the tube 10 (with the wide portron 34 of the pivot arm engaging the edge of the mouth of the tube). Thereafter, when the newspaper has been inserted and the pivot arm 26 pushed to its other extreme the arm is roughly parallel with the axis of the tube. The total allowable pivoting is then only about 90°.

Turning now to the embodiment useful with the mailbox 38, it will be clear that the signaling device cannot be mounted inside the tube which defines the mailbox. It must be mounted on the exterior and it could be mounted along the side of the mailbox or on the bottom of the mailbox, depending upon the desires of the homeowner who mounts it. This will be largely dictated by the visibility of the mailbox from some vantage point inside the house where the homeowner will be observing the mailbox. In any case, the pressure sensitive adhesive 16 will serve the same function as described in relation to the newspaper tube 10. However, in this case the side end 34 of the pivot arm will be disposed across the mouth of the mailbox. When the door 40 is closed the pivot arm will be pivoted so that the V-shaped projections or cam surfaces 36 are in engagement with the outer surface of the door 40. Thereby, the narrow end 32 of the pivot arm will serve as the signaling device to the homeowner as it will project radially outward from the surface of the mailbox.

At such time as the mailman or others open the mailbox door, the door will cam the pivot arm to a different position thereby changing the orientation of the pivot arm from one roughly perpendicular to the axis of the mailbox to one which is roughly parallel with that axis. Thereby the flag or signal portion 32 will be substantially obscured from the household observer and it will be a signal that someone has opened the door to the mailbox.

Having thus described the invention in its preferred embodiment, modifications will be obvious to those having ordinary skill in the art. However, it is not intended that the language used to describe the invention nor the drawings themselves be limiting thereof. Rather it is intended that the invention be limited only by the scope of the appended claims.

I claim:

1. In the combination of a generally linearly extending tube for receiving printed matter inserted therein and a signaling device for visually indicating to an observer who is remote from the tube that something has been inserted in the tube, the tube having an axis and being elongated with one end being open at least part of the time, the signaling device including a mounting member which extends in the same linear direction as the tube, said mounting member having one end rigidly fixed to said tube and the other end extending beyond the open end, a pivoting arm pivotally attached to said other end of said mounting member, said pivoting arm having the physical property of being able to pivot through an angle of 180°, except for the angle superintended by the thickness of the mounting member, when said mounting member is not attached to said tube, said pivoting arm being limited to pivoting through an angle not substantially greater than 90° when said mounting member is attached to said tube, said 90° angle being one where the pivoting arm extends generally parallel with the axis of the tube at one extreme and perpendicular to that axis in the other extreme, the pivoting arm including portions extending in two directions from its pivotal attachment to said mounting member, said directions being about 180° apart, one said portion being pivotable from a location parallel with the axis of the tube to a location where it extends across the end of the tube which is open at least part of the time, the one portion of the pivoting arm extendable across the end of the tube being of such a width and length that anything being pushed into or pulled from the inside of the tube will engage said one portion to thereby pivot it about 90° to orient it generally parallel with the axis, the other portion of the pivoting arm extending in its one extreme in a plane generally parallel with a plane defining the opening into said tube but beyond the tube surface a distance sufficient that it may easily be observed by said remote observer, said mounting member including a flat portion coated with adhesive at the end fixed to the tube, said mounting member further including an angled portion intermediate said flat portion and the pivot connection with the pivoting arm whereby the pivot is radially off-set from the point said mounting member is fixed to the tube.

2. The combination of claim 1 wherein the tube is always open at one end and is designed to receive newspapers or the like.

3. The combination of claim 1 wherein the tube has a door for opening and closing the open end, said door being pivoted along one edge of the opening and said tube being designed to receive mail.

4. The combination of claim 1 wherein the pivotal attachment between the mounting member and the pivoting arm comprises a cylindrical bar on one of said member and arm which is at least partially circumscribed by a pair of slotted flanges on the other of said member and arm, said slots having an open mouth which diverges inwardly to define a partially cylindrical surface of a diameter about the same as the bar.

5. The combination of claim 4 wherein the bar is attached to the mounting member and the flanges are formed integral with the pivoting arm.

6. The combination of claim 5 including at least one additional flange near the end of the pivoting arm which extends over the tube opening, the additional flange being generally V-shaped and extending from the pivoting arm toward the opening of the tube whereby a door covering the opening will engage the V-shaped flange and urge the pivoting arm to a position parallel with the tube diameter when the door is pivoted to open position.

7. The combination of claim 6 wherein the tube has a door for opening and closing the open end, said door being pivoted along one edge of the opening and said tube being designed to receive mail.

8. The combination of claim 5 wherein the tube is always open at one end and is designed to receive newspapers or the like.

* * * * *